US008651880B2

(12) United States Patent
Wu et al.

(10) Patent No.: US 8,651,880 B2
(45) Date of Patent: Feb. 18, 2014

(54) ELECTRICAL POWER CONNECTOR

(75) Inventors: Kun-Shen Wu, Taoyuan County (TW); Hao-Jan Tuan, Taoyuan County (TW)

(73) Assignee: Aces Electronics Co., Ltd., Jhongli, Taoyuan County (TW)

( * ) Notice: Subject to any disclaimer, the term of this patent is extended or adjusted under 35 U.S.C. 154(b) by 21 days.

(21) Appl. No.: 13/568,966

(22) Filed: Aug. 7, 2012

(65) Prior Publication Data

US 2013/0109239 A1 May 2, 2013

(30) Foreign Application Priority Data

Oct. 28, 2011 (TW) ..... 100220374 U

(51) Int. Cl.
*H01R 12/00* (2006.01)

(52) U.S. Cl.
USPC ..... 439/79; 439/595; 439/637

(58) Field of Classification Search
USPC ..... 439/79, 595, 637, 947, 540.1
See application file for complete search history.

(56) References Cited

U.S. PATENT DOCUMENTS

| | | | | |
|---|---|---|---|---|
| 7,828,560 | B2 * | 11/2010 | Wu et al. | 439/79 |
| 7,914,302 | B1 * | 3/2011 | Zhu | 439/79 |
| 8,092,235 | B2 * | 1/2012 | Frantum et al. | 439/79 |
| 8,282,402 | B2 * | 10/2012 | Ngo | 439/79 |

* cited by examiner

*Primary Examiner* — Hien Vu
(74) *Attorney, Agent, or Firm* — Muncy, Geissler, Olds & Lowe, P.C.

(57) ABSTRACT

An electrical power connector includes an electrically insulative housing defining multiple front mating portions, multiple rear partition plates, an accommodation chamber between each two adjacent partition plates corresponding to one respective mating portion, stepped stop portions in top and bottom sides in each mating portion and springy hooks suspending in top and bottom sides in each accommodation chamber, and pairs of conducting terminals mounted in the mounting chambers and having respective front mating end portions suspending in the mating portions with respective openings and positioning rods thereof the respectively kept in engagement with the springy hooks and stepped stop portions of the electrically insulative housing. The structural design enables the conducting terminals to have the advantages of low impedance, low power loss and high power transmission efficiency during application.

5 Claims, 11 Drawing Sheets

ELECTRICAL POWER CONNECTOR

This application claims the priority benefit of Taiwan patent application number 100220374, filed on Oct. 28, 2011.

BACKGROUND OF THE INVENTION

1. Field of the Invention

The present invention relates to electrical connector technology and more particularly, to an electrical power connector, which effectively lowers conducting terminal contact impedance and temperature.

2. Description of the Related Art

When designing an electrical connector, a designer normally will pay attention to two basic parts, i.e., signal and power supply. When designing a signal circuit, a designer normally will not consider the factor of current variation for the reason that the applied current is normally low. However, with respect to the transmission of signals, a designer may consider the nature of the carrier (high frequency, low frequency) and many other factors (static interference, magnetic interference, impedance matching, etc.) without taking the factor of temperature into account. With respect to power supply, conducting a high-current power supply through a power circuit will increase the impedance, causing a rise in temperature. Thus, when designing an electrical power connector, the factors of quick heat dissipation and low conducting terminal impedance must be considered, avoiding a significant change in the electrical characteristics.

Further, an electrical connector of this kind is generally used in a power supply device or server, and electrically connected to a circuit board for conducting power supply. FIGS. 10 and 11 illustrate two similar prior art designs of conducting terminals for electrical power connector. According to these two prior art designs, the conducting terminal A comprises a panel base A1, a front mating end portion A2 forwardly extended from the front side of the panel base A1, a rear bonding end portion A3 downwardly extended from the rear side of the panel base A1, and two barbed hooks A11 forwardly extended from the panel base A1 and suspending at two opposite lateral sides relative to the front mating end portion A2. Further, the front mating end portion A2 of the conducting terminal A defines a turning face A21, and a front guide slope A22 obliquely outwardly extended from the turning face A21. After insertion of the conducting terminal A into an electrically insulative housing, the barbed hooks A11 are forced into friction engagement with the inside wall of the electrically insulative housing, and therefore the conducting terminal A is positively secured to the inside of the electrically insulative housing. However, if the electrically insulative housing is excessively compressed, it may be damaged, or a ridged surface of the electrically insulative housing may occur. In this case, the retaining force provided by the electrically insulative housing to secure the conducting metal terminal in position will be lowered. Further, the barbed hooks A11 occupy a part of the effective conducting area of the conducting terminal A. When a high current goes through the barbed hooks A11, a high impedance will be produced, giving off heat and causing power loss. Further, a small power loss of each of a large number of electrical power connectors in a computer room leads to a large amount of power loss.

Further, the aforesaid conducting terminal A is directly made of a copper sheet member using a metal stamping technique, enabling the front mating end portion A2 of the conducting terminal A to be electrically kept in contact with a large area of the circuit board so that impedance and temperature can be reduced. However, the front mating end portion A2 of the conducting terminal A has a large surface area (see FIG. 10). Thus, the conducting terminal A must have a certain thickness to maintain the structural strength. However, increasing the thickness of the conducting terminal A will relatively lower the elastic deformation ability of the conducting terminal A, and the conducting terminal A will be damaged easily to affect its conductivity during application. Further, in the design shown in FIG. 11, elongated slits A23 are made on the front mating end portion A2 of the conducting terminal A to divide the front mating end portion A2 into multiple parts, enhancing the effects of elastic deformation. However, the structural design problem of the barbed hooks A11 remains unsettled. Therefore, structural stability of an electrical power connector is very important. Improving the structural stability of electrical power connectors is the subject people engaging in this field must take into account.

SUMMARY OF THE INVENTION

The present invention has been accomplished under the circumstances in view. It is therefore the main object of the present invention to provide an electrical power connector, which effectively lowers conducting terminal contact impedance and temperature, reducing power loss, improving power transmission efficiency and saving power consumption cost.

To achieve this and other objects of the present invention, an electrical power connector comprises an electrically insulative housing, pairs of conducting terminals mounted in the electrically insulative housing. The electrically insulative housing comprises a plurality of mating portions arranged at the front side, a plurality of partition plates disposed at the rear side, an accommodation chamber defined between each two adjacent partition plates corresponding to one respective mating portion, a mating chamber defined in each mating portion, two stepped stop portions respectively disposed in opposing top and bottom sides inside each mating chamber, and a plurality of springy hooks respectively extended from opposing top and bottom sides thereof and respectively suspending in top and bottom sides in each accommodation chamber. The conducting terminals are arranged in pairs and respectively mounted in the accommodation chambers of the electrically insulative housing. Each conducting terminal comprises a panel base, a front mating end portion forwardly extended from the panel base and suspending in the front opening of one respective mating chamber, two positioning rods forwardly extended from the panel base and suspending at two opposite lateral sides relative to the front mating end portion, at least one opening cut through opposing top and bottom sides of the panel base and engaged with one respective springy hook, and a rear bonding end portion backwardly downwardly extended from said panel base.

Using the finite element model and the same analysis parameters for the simulation analysis, the internal impedance value obtained from the conducting terminals of the present invention is lower than that obtained from the prior art conducting terminals with barbed hooks for positioning, or about 0.0234 mΩ lower. When input I=40 A into the formula for electrical power P=I2R, the conducting terminals of the present invention can reduce power loss about 37.44 mW over the prior art conducting terminals with barbed hooks for positioning, showing significant improvement.

Further, the two positioning rods of each conducting terminal are respectively stopped against the two stepped stop portions of the electrically insulative housing to enhance positioning stability of the respective conducting terminal in the respective accommodation chamber of the electrically insulative housing.

DETAILED DESCRIPTION OF THE PREFERRED EMBODIMENT

Figure 1:
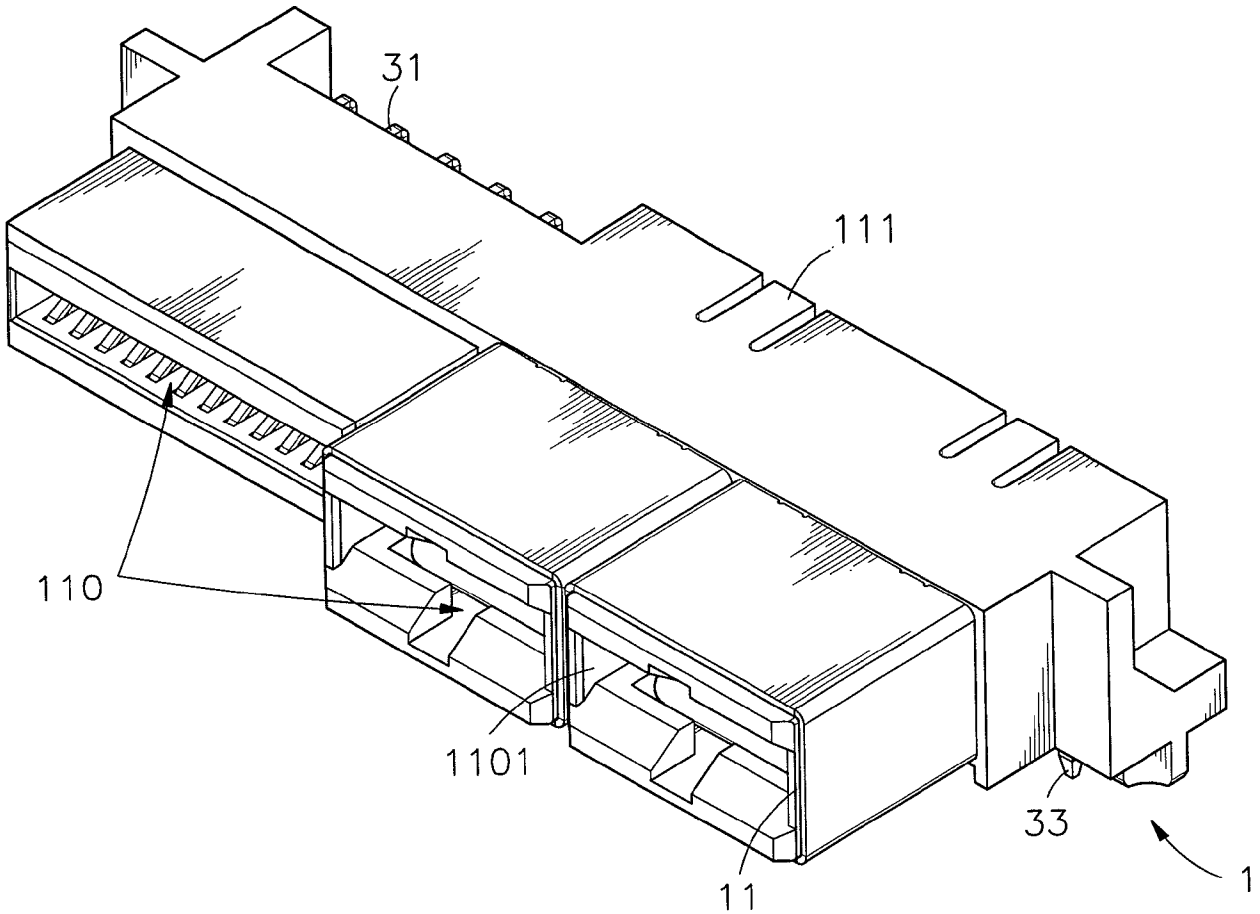
FIG. 1 is an elevational view of an electrical power connector in accordance with the present invention.
Figure 2:
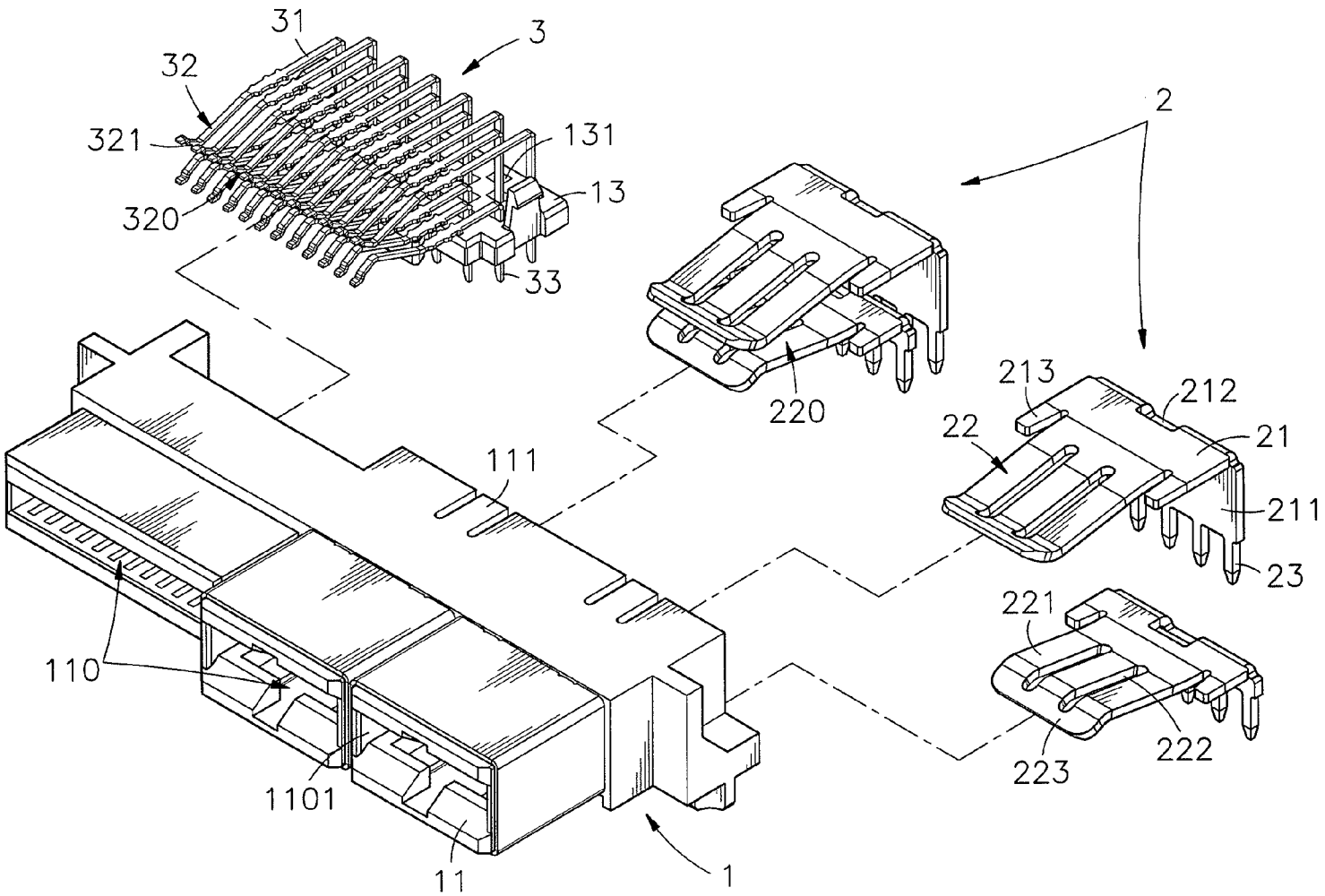
FIG. 2 is an exploded view of the electrical power connector in accordance with the present invention.
Figure 3:
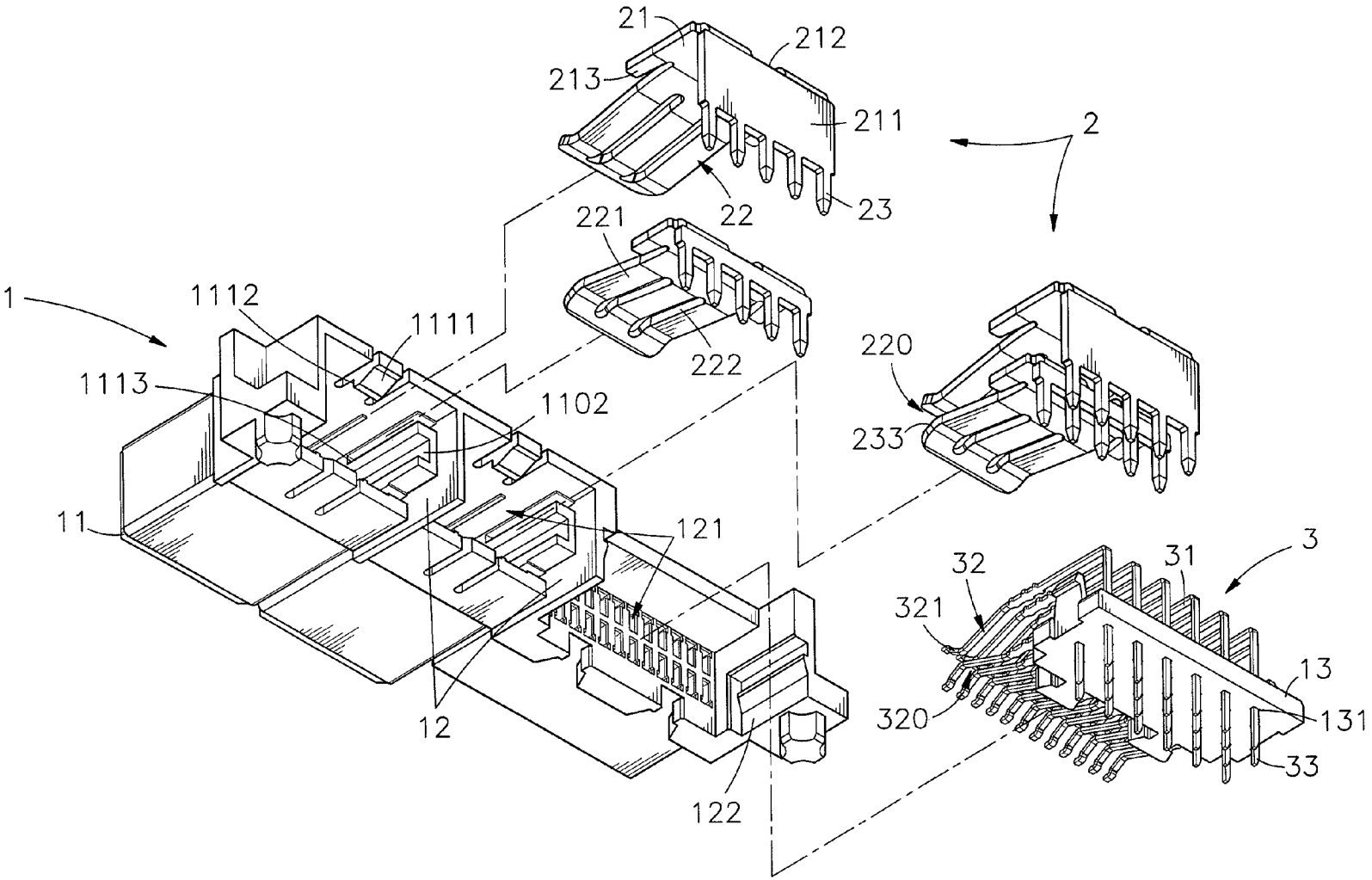
FIG. 3 corresponds to FIG. 2 when viewed from another angle.
Figure 4:
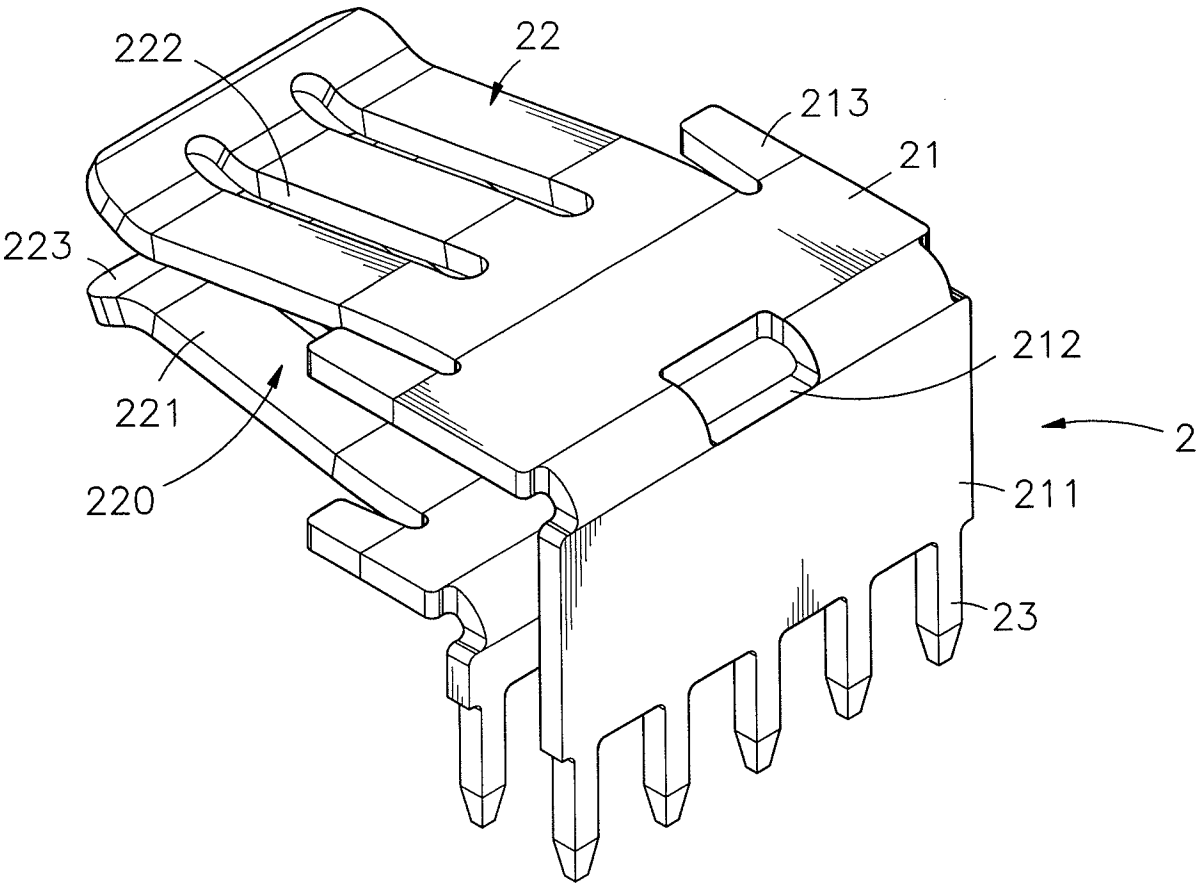
FIG. 4 is an elevational view of one pair of conducting terminals of the electrical power connector in accordance with the present invention.

Referring to FIGS. 1-4, an electrical power connector in accordance with the present invention is shown. The electrical power connector comprises an electrically insulative housing 1, and pairs of conducting terminals 2.

The electrically insulative housing 1 comprises a plurality of mating portions 11 arranged in parallel at a front side thereof, a plurality of partition plates 12 disposed at a rear side thereof, an accommodation chamber 121 defined between each two adjacent partition plates 12 corresponding to one respective mating portion 11, a mating chamber 110 defined in each mating portion 11 and defining a front opening 1101 in communication with one respective accommodation chamber 121, two guide grooves 1102 bilaterally disposed in each mating chamber 110 between the associating front opening 1101 and accommodation chamber 121, two stepped stop portions 1113 respectively disposed in opposing top and bottom sides in each accommodation chamber 121 near the associating mating chamber 110, and a plurality of springy hooks 111 respectively extended from opposing top and bottom sides thereof and respectively suspending in top and bottom sides in each accommodation chamber 121. Further, each springy hook 111 defines a bevel face 1111 located on a distal end thereof, and a vertical stop edge 1112 disposed at a back side of the bevel face 1111.

The pairs of conducting terminals 2 are respectively mounted in the accommodation chambers 121 of the electrically insulative housing 1. The two conducting terminals 2 of each pair of conducting terminals are disposed one above the other. Each conducting terminal 2 comprises a panel base 21 having a vertically downwardly extending rear connection portion 211, an opening 212 cut through opposing top and bottom sides of the rear connection portion 211 of the panel base 21, a front mating end portion 22 forwardly extended from the panel base 21 and suspending in the front opening 1101 of the corresponding accommodation chamber 121, two positioning rods 213 forwardly extended from the panel base 21 and suspending at two opposite lateral sides relative to the front mating end portion 22, and a rear bonding end portion 23 downwardly extended from the rear connection portion 211 of the panel base 21. Further, a retaining gap 220 is defined between the two vertically arranged conducting terminals 2 in each accommodation chamber 121 of the electrically insulative housing 1. Further, the front mating end portion 22 of each conducting terminal 2 defines a turning face 221, at least one, for example, two longitudinal slots 222 cut through opposing top and bottom sides of the turning face 221, and a front guide slope 223 obliquely downwardly (or obliquely upwardly) extended from the turning face 221. The front mating end portions 22 of each pair of conducting terminals 2 are obliquely inwardly extending toward each other and then obliquely outwardly extending in reversed directions.

According to this embodiment, the electrically insulative housing 1 comprises three mating portions 11, one configured subject to a first configuration design, and the other two configured subject to a second configuration design. The mating portion 11 configured subject to the first configuration design comprises a bottom opening 122 at the bottom side of the accommodation chamber 121, and a terminal block 13 mounted in the bottom opening 122. The terminal block 13 holds two vertically spaced sets of signal terminals 3. Each signal terminal 3 comprises a base portion 31, a front contact portion 32 forwardly extended from the base portion 31 and terminating in a spring arm 321 that suspends in the front opening 1101 of the respective accommodation chamber 121, and a rear bonding portion 33 backwardly extended from the base portion 31 and downwardly inserted through one respective terminal hole 131 of the terminal block 13. Further, a retaining gap 320 is defined between the front contact portions 32 of the two vertically spaced sets of signal terminals 3.

As stated above, the electrically insulative housing 1 comprises three mating portions 11, one configured subject to the first configuration design, and the other two configured subject to the second configuration design, wherein the mating portion 11 configured subject to the first configuration design is adapted for accommodating signal terminals 3, and the other two mating portions 11 configured subject to the second configuration design are adapted for accommodating the pairs of conducting terminals 2. Although the number and shape between the signal terminals 3 and the pairs of conducting terminals 2 are different, the mounting arrangement of the signal terminals 3 is substantially similar to that of the pairs of conducting terminals 2.

Figure 5:
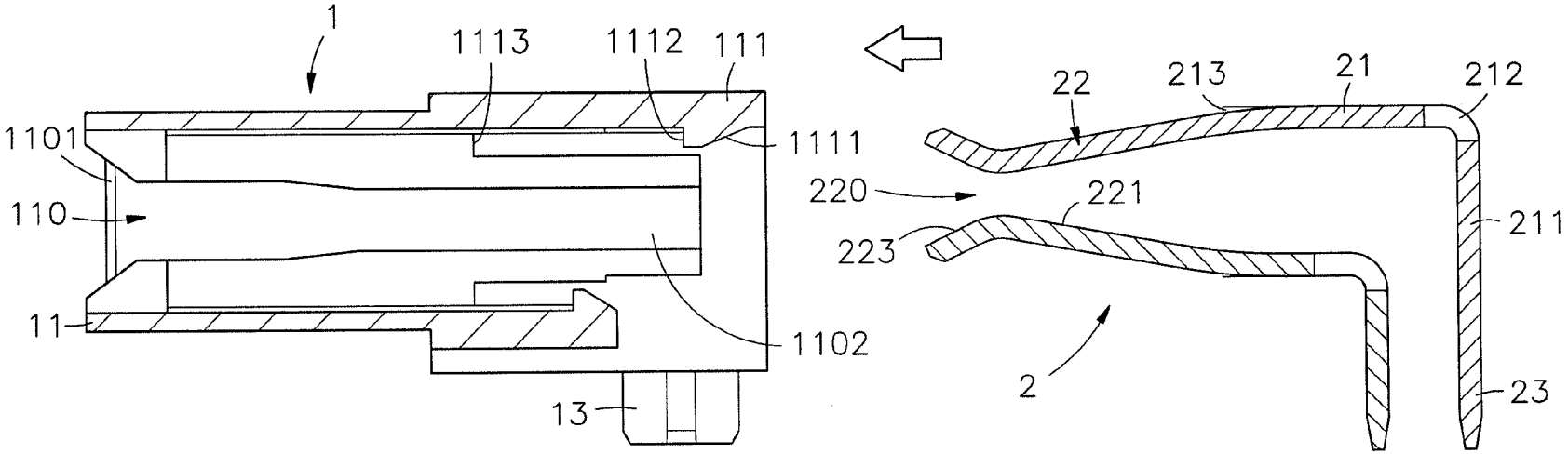
FIG. 5 is schematic sectional side view illustrating the relationship between the electrically insulative housing and one pair of conducting terminals of the electrical power connector in accordance with the present invention before assembly.
Figure 6:
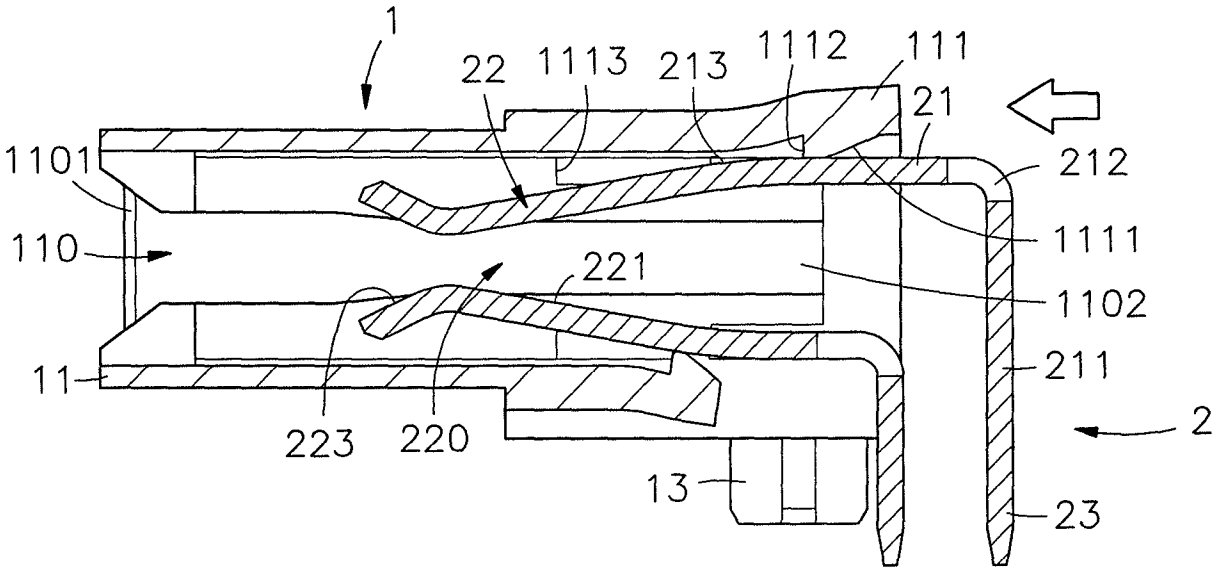
FIG. 6 corresponds to FIG. 5, illustrating the pair of conducting terminals partially inserted into the electrically insulative housing.
Figure 7:
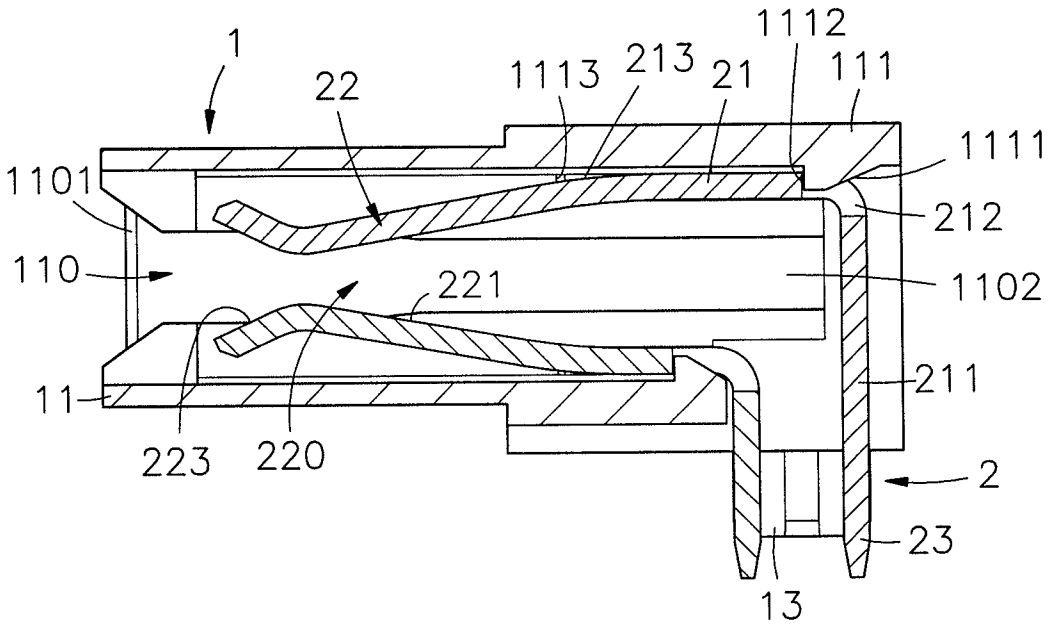
FIG. 7 corresponds to FIG. 6, illustrating the pair of conducting terminals positively positioned in the electrically insulative housing.

Referring to FIGS. 5-7, when assembling the electrical power connector, insert the front mating end portions 22 of each pair of conducting terminals 2 into each respective accommodation chamber 121 between each two respective partition plates 12 of the electrically insulative housing 1 against the bevel faces 1111 of the respective two springy hooks 111. At this time, the respective springy hooks 111 are elastically deformed for allowing the front mating end portions 22 of the respective pair of conducting terminals 2 to pass. When the front mating end portions 22 of each pair of conducting terminals 2 are set in position in the respective accommodation chamber 121, the positioning rods 213 of the respective pair of conducting terminals 2 are stopped against the respective stepped stop portions 1113 of the electrically insulative housing 1 and kept in position, and the respective springy hooks 111 immediately return to their former shape to force the vertical stop edges 1112 thereof into the openings 212 of the respective pairs of conducting terminals 2, and therefore the respective pairs of conducting terminals 2 are locked to the electrically insulative housing 1 by the respective springy hooks 111. Thus, after insertion of the respective pairs of conducting terminals 2 into respective accommodation chambers 121 of the electrically insulative housing 1, the openings 212 of the respective pairs of conducting terminals 2 are respectively forced into engagement with the vertical stop edges 1112 of the respective springy hooks 111, and the positioning rods 213 of the respective pairs of conducting terminals 2 are respectively forced into engagement with the respective stepped stop portions 1113 of the electrically insulative housing 1, and therefore the pairs of conducting terminals 2 are prohibited from displacement relative to the electrically insulative housing 1. Thus, installing the conducting terminals 2 in the electrically insulative housing 1 is quite easy. After installation of the conducting terminals 2 in the electrically insulative housing 1, the conducting terminals 2 are positively firmly secured to the electrically insulative housing 1 for conducting power supply efficiently.

Figure 8:
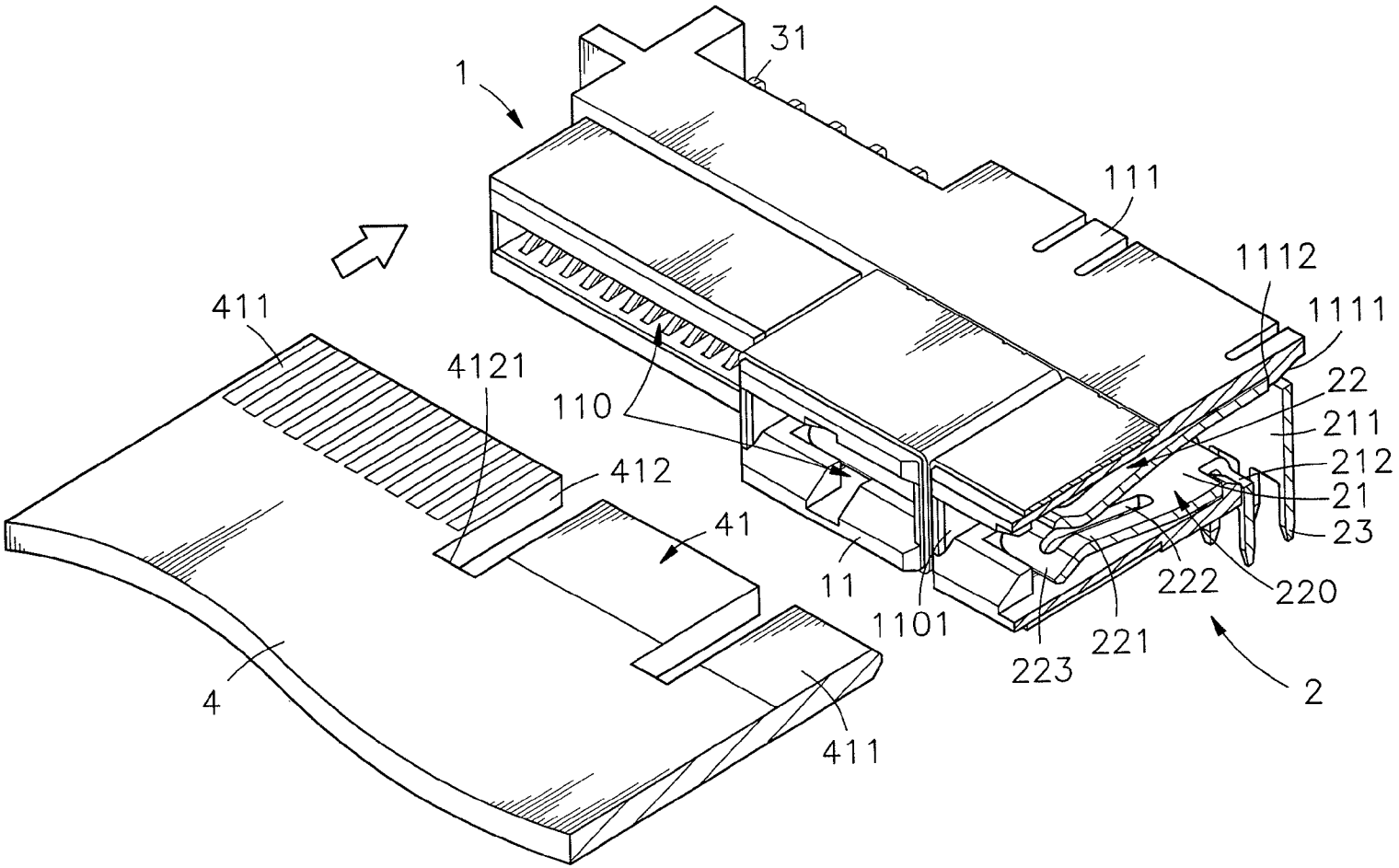
FIG. 8 is a schematic sectional elevation illustrating the relationship between the mating portions and conducting terminals of the electrically insulative housing of the electrical power connector and the connection portions of a mating circuit board in accordance with the present invention.
Figure 9:
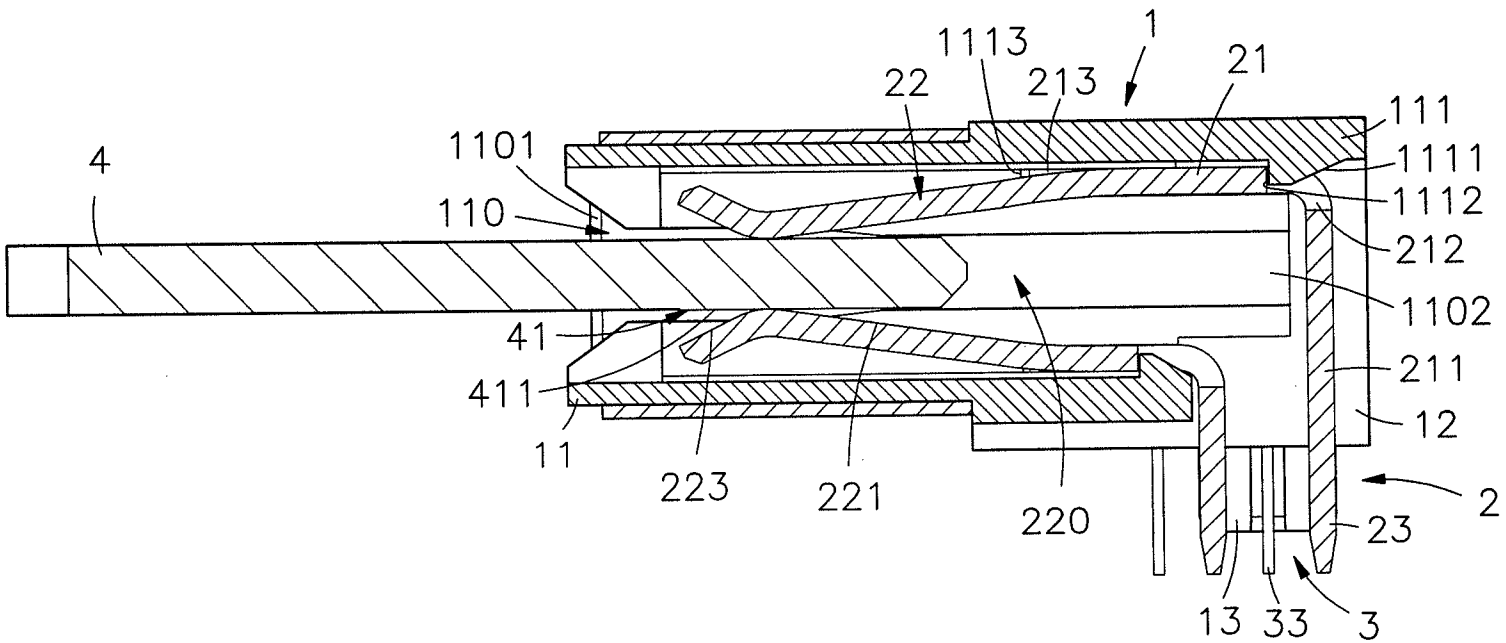
FIG. 9 is a sectional side view of the present invention, illustrating the respective connection portions of the mating circuit board inserted into the mating portions of the electrically insulative housing and kept in contact with the respective conducting terminals.
Figure 10:
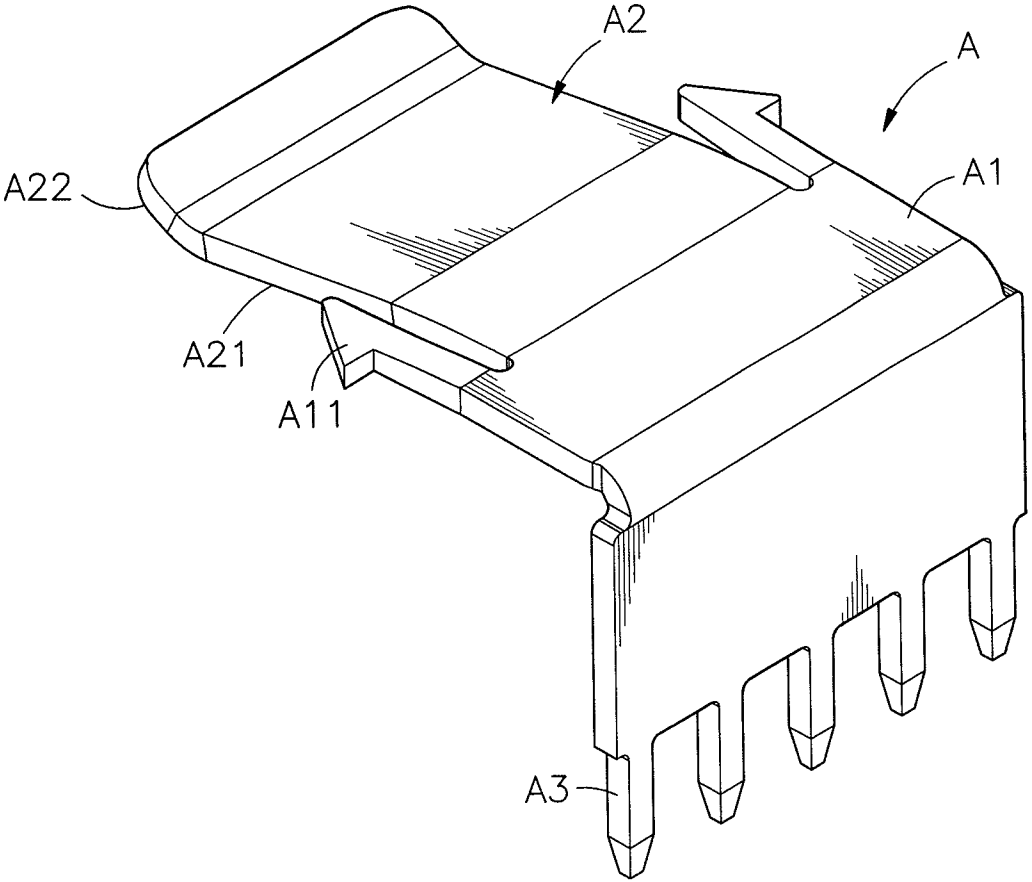
PRIOR ART FIG. 10
FIG. 10 is an elevational view of a conducting terminal for electrical power connector according to the prior art.
Figure 11:
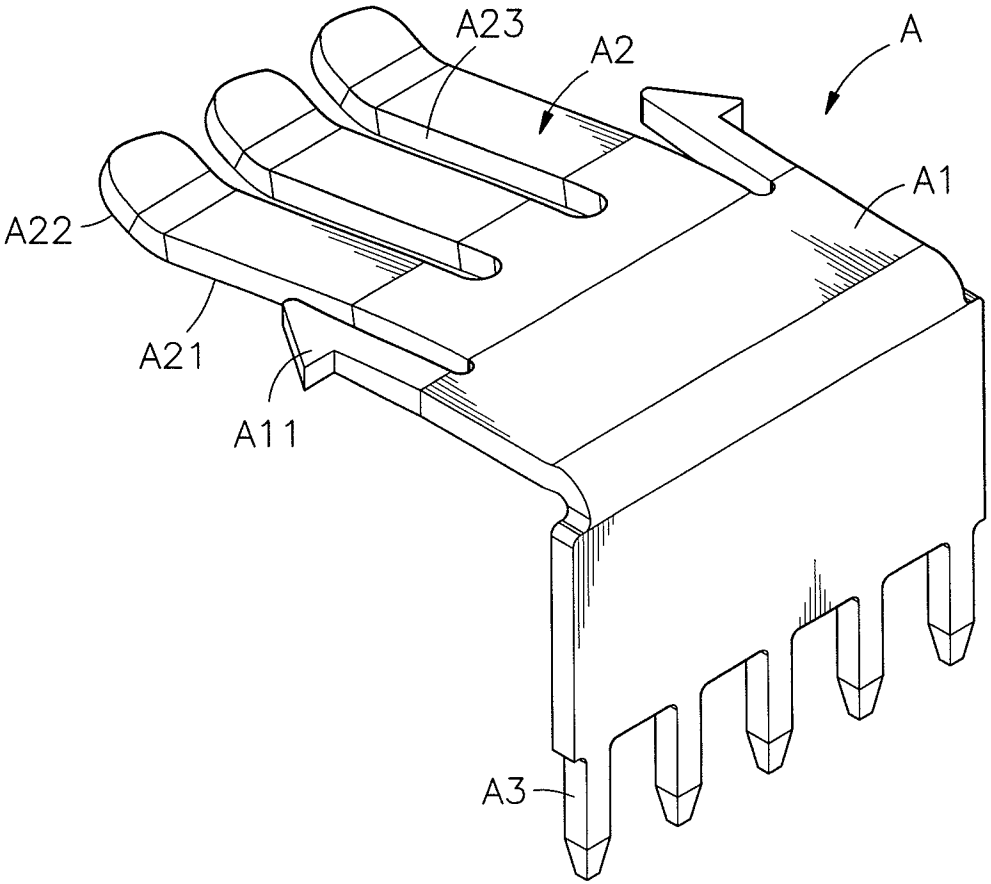
PRIOR ART FIG. 11
FIG. 11 is an elevational view of another design of conducting terminal for electrical power connector according to the prior art.

Referring to FIGS. 8 and 9, the electrical power connector is installed in a circuit board 4. The circuit board 4 comprises a plurality of connection portions 41 corresponding to the mating portions 11 of the electrical power connector, a front notch 412 defined between each two adjacent connection portions 41, a stop edge 4121 defined in each front notch 412, and a plurality of electric contacts 411 located on the opposing top and bottom sides of the connection portions 41.

During installation, the connection portions 41 of the circuit board 4 are respectively inserted through the front openings 1101 of the mating chambers 110 of the mating portions 11 of the electrically insulative housing 1 into the respective guide grooves 1102 in the respective mating chambers 110 and the retaining gaps 220 between the front mating end portions 22 of the respective pairs of conducting terminals 2 or the retaining gap 320 between the front contact portions 32 of the two vertically spaced sets of signal terminals 3. When set in position, the stop edges 4121 in the front notches 412 of the connection portions 41 of the circuit board 4 are respectively stopped against the front side of the mating portions 11 of the electrically insulative housing 1, and the turning faces 221 of the front mating end portions 22 of the pairs of conducting terminals 2 and the spring arms 321 of the front contact portions 32 of the signal terminals 3 of the terminal block 13 are respectively kept in contact with the respective electric contacts 411 at the connection portions 41 of the circuit board 4 positively. At this time, the connection portions 41 of the circuit board 4 are positively inserted into the respective guide grooves 1102 and guided by the respective guide grooves 1102 into position accurately and positively. Subject to the structural design of the guide grooves 1102, the front mating end portions 22 of the pairs of conducting terminals 2 bear the pressure evenly and are kept in positive contact with a wide surface area of the respective electric contacts 411 at the connection portions 41 of the circuit board 4 for the transmission of high currents, and therefore less impedance and temperature will be produced during transmission of high currents through the electrical power connector. Thus, a high level of reproducibility and reliability of the electrical power connector at the end of the circuit board can be obtained, assuring a high level of power transmission efficiency and safety.

During transmission of a high current after installation of the electrical power connector in the circuit board 4, heat generated by the pairs of conducting terminals 2 can be dissipated into the atmosphere through gaps in the pairs of conducting terminals 2 in the accommodation chambers 121. Further, the thickness of the circuit board 4 is much smaller than the height of the mating chambers 110 of the mating portions 11 of the electrically insulative housing 1. After insertion of respective connection portions 41 of the circuit board 4 into the mating chambers 110 of the mating portions 11 of the electrically insulative housing 1, currents of air caused by an electric fan can be guided through the mating chambers 110 of the mating portions 11 of the electrically insulative housing 1 to lower the temperature of the pairs of conducting terminals 2.

As stated above, the front mating end portion 22 of each conducting terminal 2 defines a turning face 221, at least one longitudinal slot 222 cut through opposing top and bottom sides of the turning face 221, and a front guide slope 223 obliquely downwardly (or obliquely upwardly) extended from the turning face 221. Using the finite element model and the same analysis parameters for the simulation analysis, the internal impedance value obtained from the conducting terminals 2 of the present invention is lower than that obtained from the prior art conducting terminals A that use barbed hooks A11 for positioning, or about 0.0234 mΩ lower. When input I=40A into the formula for electrical power $P=I^2R$, the conducting terminals 2 of the present invention can reduce power loss about 37.44 mW over the prior art barbed hooks A11 type conducting terminals A, showing significant improvement and supporting the theoretical basis of the invention of being capable of reducing the internal impedance value of the conducting terminals 2. When a high current is conducted through the conducting terminals 2, less impedance and heat will be produced, and therefore the conducting terminals 2 can exhibit high performance and save power consumption cost.

Referring to FIGS. 3, 4, 5 and 7 again, as stated above, each conducting terminal 2 of the present invention comprises a panel base 21 having a vertically downwardly extending rear connection portion 211, an opening 212 cut through opposing top and bottom sides of the rear connection portion 211 of the panel base 21, a front mating end portion 22 forwardly extended from the panel base 21, two positioning rods 213 forwardly extended from the panel base 21 and suspending at two opposite lateral sides relative to the front mating end portion 22, and a rear bonding end portion 23 downwardly extended from the rear connection portion 211 of the panel base 21, wherein the front mating end portion 22 of each conducting terminal 2 defines a turning face 221, at least one longitudinal slot 222 cut through opposing top and bottom sides of the turning face 221, and a front guide slope 223 obliquely downwardly (or obliquely upwardly) extended from the turning face 221. The conducting terminal 2 of the invention eliminates the structural design of barbed hooks as seen in the prior art conducting terminals, having the advantages of low impedance, low power loss and high power transmission efficiency during application Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical power connector, comprising an electrically insulative housing, said electrically insulative housing comprising a plurality of mating portions arranged in parallel at a front side thereof, at least one accommodation chamber disposed at a rear side thereof, said at least one accommodation chamber corresponding to one respective said mating portion, and at least one pair of conducting terminals respectively mounted in said at least one accommodation chamber of said electrically insulative housing and suspending in one respective said mating portion of said electrically insulative housing, Wherein said electrically insulative housing comprises two stepped stop portions respectively disposed in each said mating portion and facing toward the corresponding said accommodation chamber for stopping said at least one pair of conducting terminals in said mating portions of said electrically insulative housing, and a plurality of flexible hooks respectively extended rearwardly from opposing top and bottom sides thereof and respectively suspending in top and bottom sides in said at least one accommodation chamber;

each of said one pair of conducting terminals comprises a panel base, a front mating end portion forwardly extended from said panel base and positioning in one said mating portion of said electrically insulative housing, two positioning rods forwardly extended from the panel base and suspending at two opposite lateral sides relative to the front mating end portion, at least one opening cut through opposing top and bottom sides of said panel base and engaged with one respective said flexible hook, and a rear bonding end portion bent downwardly and extended from said panel base; and wherein the two conducting terminals of each said pair of conducting terminals are disposed one above the other, and the two positioning rods of each said conducting terminal are respectively stopped against said two stepped stop portions of said electrically insulative housing.

2. The electrical power connector as claimed in claim 1, wherein said electrically insulative housing comprises a plurality of partition plates disposed at a rear side thereof, each two adjacent said partition plates defining therebetween said at least one accommodation chamber corresponding to one respective said mating portion, and a mating chamber defined in each said mating portion, said mating chamber defining a front opening; the front mating end portion of each said conducting terminal comprises a turning face, at least one longitudinal slot cut through opposing top and bottom sides of said turning face, and a front guide slope obliquely outwardly extended from said turning face and positioning in the front opening of the mating chamber in one said mating portion of said electrically insulative housing.

3. The electrical power connector as claimed in claim 1, wherein each said flexible hook comprises a bevel face located on a distal end thereof, and a vertical stop edge disposed at a back side of said bevel face and engaged into one opening of said panel base of one said conducting terminal.

4. The electrical power connector as claimed in claim 1, wherein the two conducting terminals of each said pair of conducting terminals are arranged that a retaining gap is defined between the front mating end portions of each said pair of conducting terminals for receiving and holding one respective mating connection portion of a mating circuit board.

5. The electrical power connector as claimed in claim 1, wherein the panel base of each said conducting terminal comprises a vertically downwardly extending rear connection portion connected to the rear bonding end portion of the respective conducting terminal; the at least one opening of each said conducting terminal is located on the vertically downwardly extending rear connection portion of the panel base of the respective conducting terminal.

* * * * *